US005738009A

United States Patent [19]

Desie et al.

[11] Patent Number: 5,738,009

[45] Date of Patent: Apr. 14, 1998

[54] METHOD FOR DIRECT ELECTROSTATIC PRINTING (DEP)

[75] Inventors: Guido Desie, Herent; Herman Debie, Mol, both of Belgium

[73] Assignee: Agfa-Gevaert, Mortsel, Belgium

[21] Appl. No.: 626,936

[22] Filed: Apr. 3, 1996

[30] Foreign Application Priority Data

Apr. 3, 1995 [EP] European Pat. Off. ..... 95200834

[51] Int. Cl.[6] ..... B41M 1/12; B41J 2/41

[52] U.S. Cl. ..... 101/129; 101/DIG. 37; 347/158

[58] Field of Search ..... 101/114, 129, 101/DIG. 37; 347/153, 158

[56] References Cited

U.S. PATENT DOCUMENTS

| | | | |
|---|---|---|---|
| 3,487,775 | 1/1970 | Chaney et al. | 101/114 |
| 4,393,390 | 7/1983 | Aoki et al. | 346/155 |
| 5,230,979 | 7/1993 | Chow et al. | 430/114 |
| 5,327,169 | 7/1994 | Thompson | 347/158 |
| 5,541,716 | 7/1996 | Schmidlin | 355/261 |

FOREIGN PATENT DOCUMENTS

| | | | |
|---|---|---|---|
| 0463743 | 5/1991 | European Pat. Off. . | |
| 0617335 | 3/1994 | European Pat. Off. . | |
| 60-263962 | 12/1985 | Japan . | |
| 2108432 | 5/1983 | United Kingdom | 101/DIG. 37 |

*Primary Examiner*—John S. Hilten
*Assistant Examiner*—Amanda B. Sandusky
*Attorney, Agent, or Firm*—Baker & Botts, L.L.P.

[57] ABSTRACT

Disclosed herein is a method for direct electrostatic printing with reduced banding, which comprising the steps of creating a potential difference between a back electrode and a magnetic brush assembly having a stationary mounted core and a sleeve rotatably mounted around the core, and rotating the sleeve at a rotational speed $V_{rot}$ which is higher than 100 rotations per minute; applying a developer with toner particles and magnetically attractable carrier particles on the magnetic brush assembly; creating a flow of toner particles directly from the magnetic brush assembly to the back electrode; interposing a printhead structure, having printing apertures and control electrodes around the printing apertures, between the magnetic brush assembly and the back electrode, for image wise controlling the flow of toner particles; passing a substrate at a speed $V_{sub}$ being equal to or larger than 10 cm/min between the printhead structure and the back electrode; image wise depositing toner particles on the substrate through the printing apertures; and fixing the toner particles to the substrate.

4 Claims, 1 Drawing Sheet

METHOD FOR DIRECT ELECTROSTATIC PRINTING (DEP)

DESCRIPTION

1. Field of the Invention

This invention relates to an apparatus used in the process of electrostatic printing and more particularly in Direct Electrostatic Printing (DEP). In DEP, electrostatic printing is performed directly from a toner delivery means on a receiving member substrate by means of an electronically addressable printhead structure.

2. Background of the Invention

In DEP (Direct Electrostatic Printing) the toner or developing material is deposited directly in an imagewise way on a receiving substrate, the latter not bearing any imagewise latent electrostatic image. The substrate can be an intermediate endless flexible belt (e.g. aluminium, polyimide etc.). In that case the imagewise deposited toner must be transferred onto another final substrate. Preferentially the toner is deposited directly on the final receiving substrate, thus offering a possibility to create directly the image on the final receiving substrate, e.g. plain paper, transparency, etc. This deposition step is followed by a final fusing step.

This makes the method different from classical electrography, in which a latent electrostatic image on a charge retentive surface is developed by a suitable material to make the latent image visible. Further on, either the powder image is fused directly to said charge retentive surface, which then results in a direct electrographic print, or the powder image is subsequently transferred to the final substrate and then fused to that medium. The latter process results in an indirect electrographic print. The final substrate may be a transparent medium, opaque polymeric film, paper, etc.

DEP is also markedly different from electrophotography in which an additional step and additional member is introduced to create the latent electrostatic image. More specifically, a photoconductor is used and a charging/exposure cycle is necessary.

A DEP device is disclosed in e.g. U.S. Pat. No. 3,689,935. This document discloses an electrostatic line printer having a multi-layered particle modulator or printhead structure comprising:

- a layer of insulating material, called isolation layer;
- a shield electrode consisting of a continuous layer of conductive material on one side of the isolation layer;
- a plurality of control electrodes formed by a segmented layer of conductive material on the other side of the isolation layer; and
- at least one row of apertures.

Each control electrode is formed around one aperture and is isolated from each other control electrode.

Selected potentials are applied to each of the control electrodes while a fixed potential is applied to the shield electrode. An overall applied propulsion field between a toner delivery means and a receiving member support projects charged toner particles through a row of apertures of the printhead structure. The intensity of the particle stream is modulated according to the pattern of potentials applied to the control electrodes. The modulated stream of charged particles impinges upon a receiving member substrate, interposed in the modulated particle stream. The receiving member substrate is transported in a direction orthogonal to the printhead structure, to provide a line-by-line scan printing. The shield electrode may face the toner delivery means and the control electrode may face the receiving member substrate. A DC field is applied between the printhead structure and a single back electrode on the receiving member support. This propulsion field is responsible for the attraction of toner to the receiving member substrate that is placed between the printhead structure and the back electrode.

In U.S. Pat. No. 5,327,169 and EP-A 675 417, a DEP device having a toner cloud extracted directly from a magnetic brush, using a two-component development system have been described. These systems have the advantage that no special charged toner conveyer has to be incorporated in the apparatus between the toner source and the printhead structure and that the charge of the toner particles is well controlled. This simplifies the construction of the DEP apparatus using toner particles with well controlled charge.

A DEP device is well suited to print half-tone images. The densities variations present in a half-tone image can be obtained by modulation of the voltage applied to the individual control electrodes. However, since the human eye is extremely sensitive to small density fluctuations; it is not an easy task to print at a certain grey scale density with a high degree of homogeneity. Especially a kind of "banding" i.e. stripes of slightly different densities can be seen in a density pattern that is intended to be totally homogeneous and even.

For that reason accurate control of the distance of said toner application module and of said back electrode towards said printhead structure is very important. It has been described in European Application 94203255.8 filed on Nov. 8, 1994, that said problem can be tackled by stretching of said printhead structure in said DEP device over a well-shaped bar free.

Other descriptions in the literature are dealing with a method for correcting the image density, in the direction perpendicular to the direction of the movement of the toner receiving member, according to a pattern which is superposed upon the actual image data and, either by time or voltage modulation, corrects for the inequality in the overall image density.

In U.S. Pat. No. 5,193,011 e.g. a pixel by pixel correction is claimed by time-modulation of the different control electrodes. By using this correction method one can change the writing-voltage and/or non-writing voltage to each individual aperture so that after this correction an homogeneous image density results. A drawback of this method is that part of the time modulated grey scale is consumed by the overall density correction.

In U.S. Pat. No. 5,229,794 and European application 94203220.2, filed on Nov. 4, 1994, an apparatus is described which comprises an apertured printhead structure in which each individual aperture has a distinct shield electrode and control electrode. By applying a different voltage to each individual shield electrode of said printhead structure, it becomes possible to correct said grey-scale-printing for a homogeneous image density over the full width of said receiving member.

Although the solutions that have been proposed do improve the homogeneity of even density patterns printed by DEP, when viewed in the direction perpendicular to the direction of movement of the toner receiving member, there is still a need for a DEP system that makes it possible to print even density patterns with high homogeneity, when viewed in the direction of movement of the toner receiving member and that does not require complicated electronic of mechanical measures to ensure high homogeneity (no banding visible) in even density patterns.

OBJECTS OF THE INVENTION

It is an object of the invention to provide an improved Direct Electrostatic Printing (DEP) device, printing at high density resolution with high image homogeneity and no "banding".

It is a further object of the invention to provide a DEP device combining high spatial and density resolution with good long term stability and reliability.

It is still a further object of the invention to provide a DEP device, wherein said toner application module gives a constant and reliable flux of charged toner particles towards said printhead structure as a function of printing time.

Further objects and advantages of the invention will become clear from the description hereinafter.

The above objects are realized by providing a DEP(Direct Electrostatic Printing) device comprising a back electrode (105), a printhead structure (106), comprising an array of apertures through which a particle flow can be electrically modulated, a receiving substrate (109) moving at a speed $V_{sub}$ (cm/min) between said back electrode (105) and said printhead structure (106), a toner delivery means (101), at the front side of said printhead structure, with a magnetic brush assembly (103) comprising a core and a sleeve, and developer in said toner delivery means containing at least toner particles and magnetically attractable carrier particles; characterised in that said receiving substrate (109) moves at a speed $V_{sub} \geqq 10$ cm/min and said sleeve of said magnetic brush assembly is rotated at a speed $V_{rot}$ higher than 100 rpm (rotations per minute).

In a preferred embodiment of the present invention said sleeve of said magnetic brush assembly is rotated at a speed $V_{rot}$ and said substrate is moved at a speed $V_{sub}$ so that $V_{rot} / V_{sub} \geqq 2$.

In a further preferred embodiment said receiving substrate (109) moves at a speed $V_{sub} \geqq 28$ cm/min and said sleeve of said magnetic brush assembly is rotated at a speed $V_{rot}$ so that $V_{rot} / V_{sub} \geqq 5$.

DETAILED DESCRIPTION OF THE INVENTION

Figure 1:
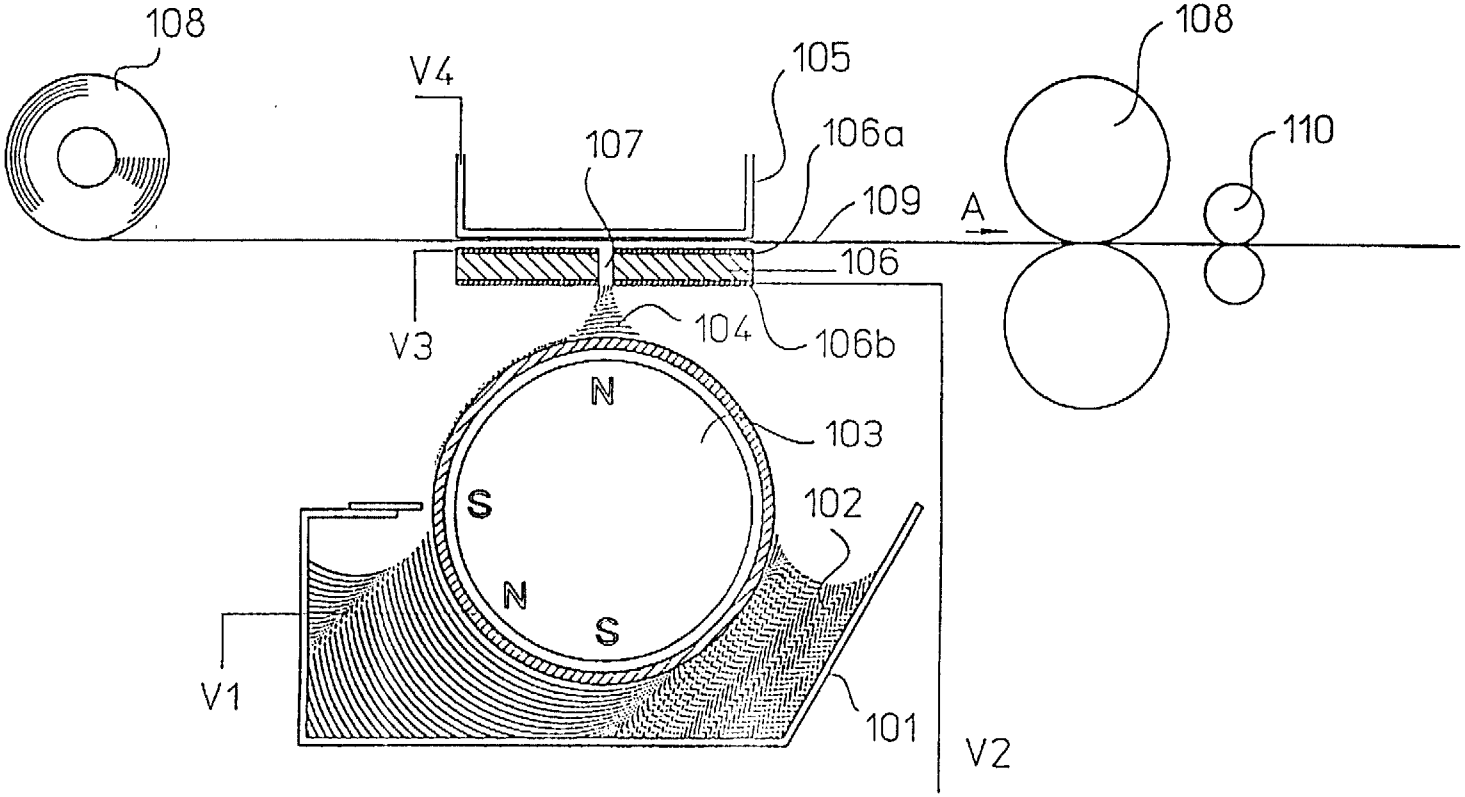
FIG. 1 is a schematic illustration of a possible embodiment of a DEP device according to the present invention.

In the literature many devices have been described that operate according to the principles of DEP (Direct Electrographic Printing). All these devices are able to perform grey scale printing either by voltage modulation or by time modulation of the voltages applied to the control electrodes. Most of the disclosed DEP devices operate with a Charged Toner Conveyer (CTC) to bring toner particles in the vicinity of a printhead structure. The toner particles are magnetic, as disclosed in, e.g., EP-A 617 335, or are non-magnetic. In that latter case the toner particles are applied to the CTC by a conventional magnetic brush from a multi-component developer comprising toner particles and magnetic carrier particles. Examples of such devices are a.o. found in e.g., U.S. Pat. No. 5,327,169 and U.S. Pat. No. 5,214,451.

The DEP-devices, as described in EP-A 675 417, operating with a multicomponent developer comprising magnetic carrier particles and toner particles and wherein the toner particles are directly brought to the printhead structure by a magnetic brush, can give raise to a kind of "banding", especially in the direction of movement of the toner receiving member, in printed patches of even density. This was especially so when fast printing was to be achieved. In the context of the present invention, fast printing means that the toner receiving substrate travels past the printhead structure at a speed $V_{sub} \geqq 10$ cm/min. This "banding" is due to density fluctuations, during the time that the printing of the even density patch proceed. We have found that reproducible density modulation as a function of printing time is possible without the introduction of time-propagating electrical signals applied to either the control electrodes (106*a*), the shield electrode (106*b*) or the toner application module (103). The most important parameter found to improve the "banding" (i.e. diminish said banding) was the rotation speed of the sleeve of the magnetic brush. This proved to be true both for a magnetic brush of the stationary core/rotating sleeve type and for a magnetic brush of the rotating core/rotating sleeve type. It was found that when the rotation speed ($V_{rot}$) of said sleeve was higher than 100 rotations per minute (rpm) the banding phenomenon was clearly diminished. It was found that the banding phenomenon was even more diminished when $V_{rot}$ (in rpm) was tuned to speed ($V_{sub}$) in cm/min of the receiving substrate moving between the back electrode and the printhead structure so that $$V_{rot}/V_{sub} \geqq 2.$$

In a DEP device according to the present invention $V_{sub} \geqq 10$ cm/min and the ratio between $V_{rot}$ and $V_{sub}$ fulfils preferably the equation $V_{rot}/V_{sub} \geqq 5$. In a further preferred embodiment or the present invention, $V_{sub} \geqq 28$ cm/min and the ratio between $V_{rot}$ and $V_{sub}$ fulfils preferably the equation $V_{rot}/V_{sub} \geqq 5$. In the most preferred embodiment of the present invention, $V_{sub} \geqq 28$ cm/min and $V_{rot}/V_{sub} \geqq 10$. The dimensions of $V_{rot}/V_{sub}$ are a number of rotation over cm.

The printhead structure used in a preferred embodiment of the present invention is made in such a way that reproducible printing is possible without clogging and with accurate control of printing density. Such a printhead structure has been described in European patent application 94203764.9 filed on Dec. 1994, which is incorporated by reference and is preferentially stretched over a 2-bar or 4-bar frame as described in European patent application 94203255.8 filed on Nov. 8, 1994.

DESCRIPTION OF THE DEP DEVICE

A non limitative example of a device for implementing a DEP method using toner particles according to the present invention comprises (FIG. 1):

(i) a toner delivery means (101), comprising a container for developer (102) and a magnetic brush assembly (103), this magnetic brush assembly forming a toner cloud (104), (ii) a back electrode (105), (iii) a printhead structure (106), made from a plastic insulating film, coated on both sides with a metallic film, (iv) conveyer means (108) to convey a receiving substrate (109) for said toner between said printhead structure and said back electrode in the direction indicated by arrow A, (v) means for fixing (110) said toner onto said image receptive member.0.0

In FIG. 1., the printhead structure (106) comprises one continuous electrode surface, hereinafter called "shield electrode" (106*b*) facing in the shown embodiment the toner delivering means and a complex addressable electrode structure, hereinafter called "control electrode" (106*a*) around printing apertures (107), facing, in the shown embodiment, the receiving substrate (109) in said DEP device. Said printing apertures are arranged in an array structure for which the total number of rows can be chosen according to the field of application. In a preferred embodiment as described later on e.g. an array of printing apertures consisting of 2 individual rows of apertures can be used. The location and/or form of the shield electrode (106*b*) and the control electrode (106*a*) can, in other embodiments of a device for a DEP method using toner particles according to the present invention, be different from the location shown in FIG. 1.

Although in FIG. 1 an embodiment of a device for a DEP method using two electrodes (106*a* and 106*b*) on printhead 106 is shown, it is possible to implement a DEP method, using toner particles according to the present invention using devices with different constructions of the printhead (106). It is, e.g. possible to implement a DEP method with a device having a printhead comprising only one electrode structure as well as with a device having a printhead comprising more than two electrode structures. It is also possible to implement a DEP device according to the present invention using a mesh isolated wires as printhead structure, as disclosed in e.g., U.S. Pat. No. 5,036,341. The apertures in these printhead structures can have a constant diameter, or can have a broader entrance or exit diameter.

The back electrode (105) of this DEP device can also be made to cooperate with the printhead structure, said back electrode being constructed from different styli or wires that are galvanically isolated and connected to a voltage source as disclosed in e.g. U.S. Pat. No. 4,568,955 and U.S. Pat. No. 4,733,256. The back electrode, cooperating with the printhead structure, can also comprise one or more flexible PCB's (Printed Circuit Board).

Between said printhead structure (106) and the magnetic brush assembly (103) as well as between the control electrode around the apertures (107) and the back electrode (105) behind the toner receiving member (109) as well as on the single electrode surface or between the plural electrode surfaces of said printhead structure (106) different electrical fields are applied. In the specific embodiment of a device, useful for a DEP method, wherein the sleeve of the magnetic brush rotates at least at 100 rpm, according to the present invention, shown in FIG. 1. voltage V1 is applied to the sleeve of the magnetic brush assembly 103, voltage V2 to the shield electrode 106*b*, voltages $V3_0$ up to $V3_n$ for the control electrode (106*a*). The value of V3 is selected, according to the modulation of the image forming signals, between the values $V3_0$ and $V3_n$, on a timebasis or grey-level basis. Voltage V4 is applied to the back electrode behind the toner receiving member. In other embodiments of the present invention multiple voltages $V2_0$ to $V2_n$ and/or $V4_0$ to $V4_n$ can be used.

The magnetic brush assembly 103 used in a DEP device according to the present invention can be either of the type with stationary core and rotating sleeve or of the type with rotating core and rotating or stationary sleeve.

The use of a magnetic brush of the rotating sleeve/stationary core is preferred in a DEP device according to the present invention. Especially preferred is a magnetic brush with rotating sleeve and stationary core, said magnetic brush having a curvature in the development zone fulfilling the equation I:

$$R > \frac{C^2}{4.25B + 0.25} \qquad \text{I}$$

wherein the curvature R of said magnetic brush in the development zone is expressed as the radius (in mm) of a circle that best fits to said curvature of said magnetic brush in the development zone, B is the distance between the surface of said sleeve of said magnetic brush to the surface of said printhead structure, facing said magnetic brush and C is the extension (in mm) of the array of printing apertures (107) in the direction of the movement of said receiving substrate (109) measured from the middle of the apertures in the first row to the middle of the apertures in the last row. A magnetic brush fulfilling the equation above has been described in European Application 95200556.9 filed on Mar. 7, 1995, which in incorporated herein by reference.

In a DEP device, according to the present invention, any type of known carrier particles and toner particles can successfully be used. It is however preferred to use "soft" magnetic carrier particles. "Soft" magnetic carrier particles useful in a DEP device according to the present invention are soft ferrite carrier particles. Such soft ferrite particles exhibit only a small amount of remanent behaviour, characterised in coercivity values ranging from about 50 up to 250 Oe. Further very useful soft magnetic carrier particles, for use in a DEP device according to the present invention, are composite carrier particles, comprising a resin binder and a mixture of two magnetites having a different particle size as described in EP-B 289 663. The particle size of both magnetites will vary between 0.05 and 3 μm. The carrier particles have preferably an average volume diameter ($d_{v50}$) between 10 and 300 μm, preferably between 20 and 100 μm. More detailed descriptions of carrier particles, as mentioned above, can be found in EP-A 675 417, titled "A method and device for direct electrostatic printing (DEP)", that is incorporated herein by reference.

It is preferred to use in a DEP device according to the present invention, toner particles with an absolute average charge (|q|) corresponding to 1 fC≦|q|≦20 fc, preferably to 1 fC ≦|q|≦10 fc. Moreover it is preferred that the charge distribution is narrow, i.e. shows a distribution wherein the coefficient of variability (v), i.e. the ratio of the standard deviation to the average value, is equal to or lower than 0.33. Preferably the toner particles used in a device according to the present invention have an average volume diameter ($d_{v50}$) between 1 and 20 μm, more preferably between 3 and 15 μm. More detailed descriptions of toner particles, as mentioned above, can be found in EP-A 675 417, titled "A method and device for direct electrostatic printing (DEP)", that is incorporated herein by reference.

A DEP device making use of the above mentioned marking toner particles can be addressed in a way that enables it to give black and white. It can thus be operated in a "binary way", useful for black and white text and graphics and useful for classical bilevel halftoning to render continuous tone images. A DEP device according to the present invention is especially suited for rendering an image with a plurality of grey levels. Grey level printing can be controlled by either an amplitude modulation of the voltage V3 applied on the control electrode 106*a* or by a time modulation of V3. By changing the duty cycle of the time modulation at a specific frequency, it is possible to print accurately fine differences in grey levels. It is also possible to control the grey level printing by a combination of an amplitude modulation and a time modulation of the voltage V3, applied on the control electrode. The combination of a high spatial resolution and of the multiple grey level capabilities typical for DEP, opens the way for multilevel halftoning techniques, such as e.g. described in the European patent application number 94201875.5 filed on Jun. 29, 1994 with title "Screening method for a rendering device having restricted density resolution". This enables the DEP device, according to the present invention, to render high quality images.

EXAMPLES

A printhead structure 106 was made from a polyimide film of 50 μm thickness, double sided coated with a 17 μm thick copper film. The printhead structure 106 had two rows of printing apertures (107), said apertures having a square shape of 200 by 200 micron. At the back side of said printhead structure each aperture had a square copper electrode of 50 micron around each aperture, said 2 rows of apertures isolated from each other by a 100 micron broad isolation zone. This printhead structure had a resolution of 127 dpi (50 dots per cm) and was fabricated using the technique of plasma etching. Each of said control electrodes was individually addressable from a high voltage power supply. On the front side of the printhead structure, facing the toner delivery means, a common shield electrode was present.

The toner delivery means 101 was a stationary core/rotating sleeve type magnetic brush (103) comprising two mixing rods and one metering roller. One rod was used to transport the developer through the unit, the other one to mix toner with developer.

The magnetic brush assembly 103 was constituted of the so called magnetic roller, which in this case contained inside the roller assembly a stationary magnetic core, showing nine magnetic poles with an open position to enable used developer to fall off from the magnetic roller. The magnetic roller contained also a sleeve, fitting around said stationary magnetic core, and giving to the magnetic brush assembly an overall diameter of 20 mm. The sleeve was made of stainless steel toughened with a fine grain to assist in transport (Ra=3 μm) and showed an external magnetic field strength in the developing nip of 0.450 T.

A scraper blade was used to force developer to leave the magnetic roller. And on the other side a doctoring blade was used to meter a small amount of developer onto the surface of said magnetic brush assembly. The sleeve was rotating at a speed as tabulated in table 1, the internal elements rotating at such a speed as to conform to a good internal transport within the development unit. The magnetic brush assembly 103 was connected to an AC power supply with a square wave oscillating field of 600 V at a frequency of 3.0 kHz with 0 V DC-offset.

A macroscopic "soft" ferrite carrier consisting of a MgZn-ferrite with average particle size 50 μm, a magnetisation at saturation of 29 emu/g was provided with a 1 μm thick acrylic coating. The material showed virtually no remanence.

The toner used for the experiment had the following composition: 97 parts of a co-polyester resin of fumaric acid and propoxylated bisphenol A, having an acid value of 18 and volume resistivity of $5.1\times10^{16}$ ohm.cm was melt-blended for 30 minutes at 110° C. in a laboratory header with 3 parts of Cu-phthalocyanine pigment (Colour Index PB 15:3). A resistivity decreasing substance having the following structural formula: $(CH_3)_3N^+C_{16}H_{33}Br^-$ was added in a quantity of 0.5% with respect to the binder. It was found that—by mixing with 5% of said ammonium salt—the volume resistivity of the applied binder resin was lowered to $5\times10^{14}$ Ω.cm. This proves a high resistivity decreasing capacity (reduction factor:100).

After cooling, the solidified mass was pulverized and milled using an ALPINE Fliessbettgegenstrahlmühle type 100AFG (tradename) and further classified using an ALPINE multiplex zig-zag classifier type 100MZR (tradename). The resulting particle size distribution of the separated toner, measured by Coulter Counter model Multisizer (tradename), was found to be 6.3 μm average by number and 8.2 μm average by volume. In order to improve the flowability of the toner mass, the toner particles were mixed with 0.5% of hydrophobic colloidal silica particles (BET-value 130 $m^2/g$).

An electrostatographic developer was prepared by mixing said mixture of toner particles and colloidal silica in a 4% ratio (w/w) with carrier particles. The tribo-electric charging of the toner-carrier mixture was performed by mixing said mixture in a standard tumbling set-up for 10 min. The developer mixture was run in the development unit (magnetic brush assembly) for 5 minutes, after which the toner was sampled and the tribo-electric properties were measured, according to a method as described in the above mentioned EP-A 675 417, giving q=−7.1 fC, q as defined in said application.

The distance B between the front side of the printhead structure 106 and the sleeve of the magnetic brush assembly 3, was set at 400 μm. The distance between the back electrode 105 and the back side of the printhead structure 106 (i.e. control electrodes 106*a*) was set to 150 μm. The receiving substrate (109) was paper and moved at various speeds ($V_{sub}$ in cm/min) as indicated in table 1. The shield electrodes 106*b*, 106*c* were grounded: V2=0 V. To the individual control electrodes an (imagewise) voltage V3 between 0 V and −300 V was applied. The backelectrode 105 was connected to a high voltage power supply of +400 V. To the sleeve of the magnetic brush an AC voltage of 600 V at 3.0 kHz was applied, without DC offset.

Several prints of even densities were made with this kind of DEP, device. In the different printing experiments the rotation speed of the magnetic brush ($V_{rot}$) and the speed of movement of the toner receiving substrate ($V_{sub}$) were changed. The different combinations of $V_{rot}$ and $V_{sub}$ are listed in table 1.

In the same table 1 the homogeneity of the even density patches is given under heading SIG and have been measured according to test A as described hereafter.

TEST A

Measurement of Print Quality Measuring the Standard Deviation of the Density

The printing was done on paper and the density patches were measured in reflection mode.

The homogeneity of a patch of even densities was expressed with respect to the visibility of density differences, i.e. to the way a human observer would perceive these differences. Therefore, the measured values of density variations (in fact a well known $\sigma_D$) were recalculated to density variations as perceived by a human observer. In practice, a sample of even density patches printed on paper was scanned in the direction of the movement of the receiving substrate with a slit of 2 mm by 27 μm and a spatial resolution of 10 μm. The sampling distance was 1 cm and 1024 data points were sampled. The sampling proceeded in reflection mode and the reflectances where measured.

Said obtained scan of the reflectances was converted to a "perceived" image by means of a perception model. This conversion comprises the following steps:

(i) applying visual filtering, describing the spatial frequency characteristics of the "early" eye, i.e. only taking in account the receiving characteristics of the eye. The filter used has been described in detail by J. Sullivan et al. in IEEE Transactions on Systems, Man and Cybernetics, vol. 21, n° 1 p. 33 to 38, 1991.

Contrary to the filter described in said reference, the filter was not levelled off to a value of one for frequencies lower than the frequency of maximum sensitivity of said early eye. This means that in measurement A a band-pass filter was used, instead of a low-pass filter in the reference cited above. The viewing distance was 40 cm.

(ii) transforming the reflectances (R), that have been transformed in step (i) by the filtering, to visual densities ($D_{vis}$), by following formula's:

$$D_{vis}=2.55\times(1-R^{1/3})$$

when the reflectance (R) is higher than or equal to 0.01, and $$D_{vis}=2.00$$

when the reflectance (R) is lower than 0.01, while the eye can differentiate reflectances below 0.01.

In the thus obtained "perceived" image the standard deviation of the density fluctuation (SIG) was calculated.

The results of this analysis are given in table 1. A value for the parameter SIG smaller than 0.045 means acceptable image quality, in terms of homogeneity of even density patterns, a value smaller than 0.030 means excellent quality, a value of 0.025 to 0.020 is typical for offset high-quality.

TABLE 1

| Experiment n° | $V_{sub}$ cm/min | $V_{rot}$ rpm | $V_{rot}/V_{sub}$ | SIG |
|---|---|---|---|---|
| 1 | 56 | 150 | 2.6 | 0.041 |
| 2 | 56 | 300 | 5.3 | 0.040 |
| 3 | 28 | 300 | 10.7 | 0.039 |
| 4 | 14 | 300 | 21.4 | 0.028 |
| 5 | 14 | 105 | 7.5 | 0.041 |
| 6 | 28 | 1000 | 35.7 | 0.022 |
| 7 | 28 | 50 | 1.8 | 0.060 |
| 8 | 56 | 100 | 1.8 | 0.048 |
| 9 | 56 | 60 | 1.1 | 0.049 |

Having described in detail preferred embodiments of the current invention, it will now be apparent to those skilled in the art that numerous modifications can be made therein without departing from the scope of the invention as defined in the following claims. Better homogeneous printing of even density patches with a DEP device utilizing charged toner conveyer (CTC) means different from a magnetic brush (e.g. a belt conveying the charged toner to the printhead structure) can also be improved by giving the CTC a minimum speed in the neighbourhood of the printhead structure and by adapting said minimum speed to the travelling speed of the toner receiving substrate.

We claim:

1. A method for direct electrostatic printing with reduced banding, comprising the steps of:

(a) creating a potential difference between a back electrode and a magnetic brush assembly having a stationary mounted core and a sleeve rotatably mounted around said core and rotating said sleeve at a rotational speed $V_{rot}$ higher than 100 rotations per minute;

(b) applying a developer with toner particles and magnetically attractable carrier particles on said magnetic brush assembly;

(c) creating a flow of toner particles directly from said magnetic brush assembly to said back electrode;

(d) interposing a printhead structure, having printing apertures and control electrodes around said printing apertures, between said magnetic brush assembly and said back electrode, for image wise controlling said flow of toner particles;

(e) passing a substrate a a speed $V_{sub}$ being equal to or larger than 10 cm/min between said printhead structure and said back electrode;

(f) image wise depositing toner particles on said substrate through said printing apertures and (g) fixing said toner particles to said substrate;

wherein said sleeve of said magnetic brush assembly is rotated at a speed $V_{rot}$ so that $V_{rot}/V_{sub}\geqq 2$.

2. A method for direct electrostatic printing with reduced banding, comprising the steps of:

(a) creating a potential difference between a back electrode and a magnetic brush assembly having a stationary mounted core and a sleeve rotatably mounted around said core and rotating said sleeve at a rotational speed $V_{rot}$ higher than 100 rotations per minute;

(b) applying a developer with toner particles and magnetically attractable carrier particles on said magnetic brush assembly;

(c) creating a flow of toner particles directly from said magnetic brush assembly to said back electrode;

(d) interposing a printhead structure, having printing apertures and control electrodes around said printing apertures, between said magnetic brush assembly and said back electrode, for image wise controlling said flow of toner particles;

(e) passing a substrate at a speed $V_{sub}$ being equal to or larger than 10 cm/min between said printhead structure and said back electrode;

(f) image wise depositing toner particles on said substrate through said printing apertures and (g) fixing said toner particles to said substrate;

wherein said sleeve of said magnetic brush assembly is rotated at a speed $V_{rot}$ so that $V_{rot}/V_{sub}\geqq 5$.

3. The method according to claim 2, wherein said substrate is passed between said printhead structure and said back electrode at a speed $V_{sub}\geqq 28$ cm/min.

4. A method for direct electrostatic printing with reduced banding, comprising the steps of:

(a) creating a potential difference between a back electrode and a magnetic brush assembly having a stationary mounted core and a sleeve rotatably mounted around said core and rotating said sleeve at a rotational speed $V_{rot}$ higher than 100 rotations per minute;

(b) applying a developer with toner particles and magnetically attractable carrier particles on said magnetic brush assembly;

(c) creating a flow of toner particles directly from said magnetic brush assembly to said back electrode;

(d) interposing a printhead structure, having printing apertures and control electrodes around said printing apertures, between said magnetic brush assembly and said back electrode, for image wise controlling said flow of toner particles;

(e) passing a substrate at a speed $V_{sub}$ being equal to or larger than 10 cm/min between said printhead structure and said back electrode;

(f) image wise depositing toner particles on said substrate through said printing apertures and (g) fixing said toner particles to said substrate;

wherein said substrate is passed between said printhead structure and said back electrode at speed $V_{sub}\geqq 28$ cm/min and said sleeve of said magnetic brush assembly is rotated at a speed $V_{rot}$ so that $V_{rot}/V_{sub}\geqq 10$.

* * * * *